US010056208B2

(12) United States Patent
To et al.

(10) Patent No.: US 10,056,208 B2
(45) Date of Patent: Aug. 21, 2018

(54) QUICK ARC-BREAKING CIRCUIT-BREAKER

(71) Applicant: Technology Power International Limited, Kwai Chung, Kowloon (HK)

(72) Inventors: ManFuk To, Kowloon (HK); Kenny Ho, Kowloon (HK)

(73) Assignee: Technology Power International Limited, Kwai Chung, Kowloon (HK)

( * ) Notice: Subject to any disclaimer, the term of this patent is extended or adjusted under 35 U.S.C. 154(b) by 0 days.

(21) Appl. No.: 15/313,914

(22) PCT Filed: May 15, 2015

(86) PCT No.: PCT/CN2015/079054

§ 371 (c)(1),
(2) Date: Apr. 28, 2017

(87) PCT Pub. No.: WO2015/180575

PCT Pub. Date: Dec. 3, 2015

(65) Prior Publication Data

US 2017/0229263 A1 Aug. 10, 2017

(30) Foreign Application Priority Data

May 27, 2014 (CN) ..... 2014 1 0229550

(51) Int. Cl.
*H01H 33/04* (2006.01)

(52) U.S. Cl.
CPC ..... *H01H 33/04* (2013.01); *H01H 2235/01* (2013.01)

(58) Field of Classification Search
CPC ..... H01H 33/04; H01H 33/06; H01H 33/08; H01H 2235/01; H01H 73/04; H01H 73/18; H01H 9/32; H01H 9/34
USPC ..... 218/149, 89, 107, 117; 200/502, 506
See application file for complete search history.

(56) References Cited

U.S. PATENT DOCUMENTS 3,274,363 A * 9/1966 McGirr ..... H01H 9/32 337/405
4,677,266 A * 6/1987 Belbel ..... H01H 9/32 218/117
4,700,030 A * 10/1987 Belbel ..... H01H 9/32 218/117

(Continued)

*Primary Examiner* — Renee Luebke
*Assistant Examiner* — William Bolton
(74) *Attorney, Agent, or Firm* — Erickson Kernell IP, LLC; Kent R. Erickson

(57) ABSTRACT

The invention discloses a quick arc-breaking circuit-breaker, comprising two electrode contacts for switching on and switching off a circuit, and a plurality of partition plates arranged between the two electrode contacts and configured in such a way that, when the two electrode contacts are separated, the partition plates are inserted at the fastest speed between the two electrode contacts, to quickly break the arc and stop burning. As the partition plates of the quick arc-breaking circuit-breaker are inserted between the two electrode contacts from different directions, the breaking and insulating speed is accelerated, the isolation and sealing effects between the two electrode contacts are enhanced, and the insulation and arc extinguishing effects of the circuit-breaker are thus improved. The circuit-breaker of the invention has a simple structure and a low manufacturing cost.

7 Claims, 10 Drawing Sheets

(56) References Cited

U.S. PATENT DOCUMENTS

| | | | | |
|---|---|---|---|---|
| 4,801,772 | A * | 1/1989 | Bratkowski | H01H 9/32 218/117 |
| 5,761,025 | A * | 6/1998 | Iversen | H01H 9/32 361/617 |
| 6,512,190 | B2 * | 1/2003 | Leve | H01H 9/32 200/506 |

* cited by examiner

QUICK ARC-BREAKING CIRCUIT-BREAKER

CROSS-REFERENCE TO RELATED APPLICATIONS

This application claims priority from Chinese Patent Application No. 201410229550.0 filed May 27, 2014, the contents of which are incorporated herein by this reference.

FIELD OF THE INVENTION

The present invention relates to a circuit-breaker, and more specifically, to a circuit-breaker with partition plates.

BACKGROUND OF THE INVENTION

A circuit-breaker is a switching device capable of switching on, loading and switching off current under normal circuit conditions, and capable of switching on, loading and switching off current within a specified time under abnormal circuit conditions.

Arc is a gas discharge phenomenon, and is a transient spark produced by current via certain insulating media, such as air. An arc not only has a great destructive effect on contacts, but also prolongs the time of switching off a circuit.

At present, various circuit-breakers have been applied widely in real life. In conventional techniques, circuit-breakers can switch off and insulate quickly under abnormal circuit conditions, the circuit-breakers generally use the air as a medium for insulation, contact separation must reach a long distance to achieve enough degree of insulation, moreover, an arc which is produced during contact separation may easily continue to burn in the air between contacts, and as a result, the contacts are damaged. In general, the circuit-breakers of the conventional techniques have the defects of poor insulation, low arc breaking speed, poor isolation and sealing, and poor arc distinguishing effect.

SUMMARY OF THE INVENTION

In order to solve the above-mentioned technical problems, an objective of the invention is to provide a circuit-breaker which is capable of quickly breaking an arc and stopping burning and which has good breaking, insulation and sealing effects. The technical solution adopted by the invention is as follows.

A quick arc-breaking circuit-breaker, comprising two electrode contacts for switching on and off a circuit, and a plurality of partition plates arranged between the two electrode contacts, wherein the plurality of partition plates are arranged along corresponding directions with a center defined by a contact position in a vertical plane between the two electrode contacts, respectively; each two adjacent partition plates in the corresponding directions are disposed in staggered relationship with side surfaces thereof in contact with each other, and configured in such a way that, when the two electrode contacts are disconnected, at least one of each two adjacent partition plates in the corresponding directions slides relative to the other between the two electrode contacts.

In a first preferred embodiment of the invention, the plurality of partition plates are arranged respectively on both sides with the contact position as a center in the vertical plane between the two electrode contacts, and configured in such a way that, when the two electrode contacts are disconnected, at least one of each two adjacent partition plates on both sides slides relative to the other between the two electrode contacts.

In a second preferred embodiment of the invention, the plurality of partition plates are arranged respectively in three corresponding directions with the center defined by the contact position in the vertical plane between the two electrode contacts, and configured in such a way that, when the two electrode contacts are disconnected, at least one of each two adjacent partition plates slides relative to the other between the two electrode contacts.

Preferably, at least one of the two corresponding partition plates on both sides is provided with a notch or a through hole for allowing the electrode contacts to pass through, the notch is arranged at a corner or side edge position of the partition plate, and the through hole is arranged in the partition plate.

Preferably, the notch or the through hole has a size slightly greater than the cross section of the electrode contacts, so that the electrode contacts can just pass through the through hole.

Preferably, at least one of the partition plates is connected to a pressure spring and abuts against the electrode contacts, and the pressure spring is configured to force the at least one of the partition plates to slide between the two electrode contacts when the electrode contacts are separated.

Preferably, the partition plates are provided with limit blocks for limiting the travels of the partition plates.

Preferably, the partition plates are inserted in or pulled from between the two electrode contacts linearly.

Preferably, each of the partition plates is provided with a pivoted shaft for being swingable in a direction around the pivoted shaft, to be inserted in or withdrawn from between the two electrode contacts.

Resulting from the above technical solution, the invention has the following beneficial effects.

By arranging the plurality of partition plates between the electrode contacts, the invention enhances the insulation and arc extinguishing effects of the circuit-breaker during circuit breaking. As the plurality of partition plates can be inserted simultaneously between the two electrode contacts from different directions, the breaking and insulation speed the circuit-breaker as well as the isolation and sealing effects between each two electrode contacts according to the invention are enhanced. Moreover, the circuit-breaker according to the invention has a simple structure, low manufacturing costs, and high economic and social benefits.

In addition to the above, in the invention the partition plates are provided with the notches or the through holes, which are designed in line with the size and shape of the cross section of the electrode contacts, whereby the insulation and sealing effects are better when the circuit-breaker is switched off. Since each two adjacent partition plates are placed in staggered relationship and against each other by side surfaces, the partition plates can slide relative to each other while inserted in between the two electrode contacts, and thereby prevent mutual collision between the two adjacent partition plates. Since the pressure springs are arranged on the partition plates to force the partition plates against the electrode contacts, the insertion of the partition plates is faster.

The present invention can be applied widely to various circuit-breakers.

BRIEF DESCRIPTION OF THE DRAWINGS

The invention will be further described below by specific embodiments with reference to the drawings.

DETAILED DESCRIPTION OF THE EMBODIMENTS

Figure 3:
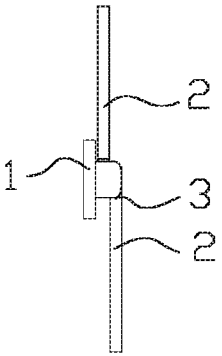
FIG. 3 is a lateral cross-sectional view of the circuit-breaker in the first embodiment of the invention.
Figure 2:
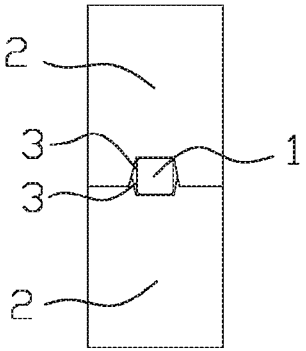
FIG. 2 is a front view of the circuit-breaker in the first embodiment of the invention.
Figure 1:
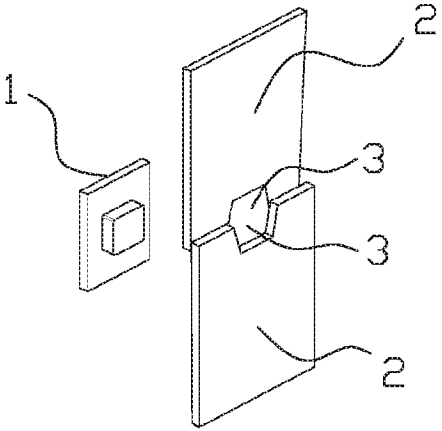
FIG. 1 is a schematic view of a circuit-breaker in a first embodiment of the invention.
Figure 4:
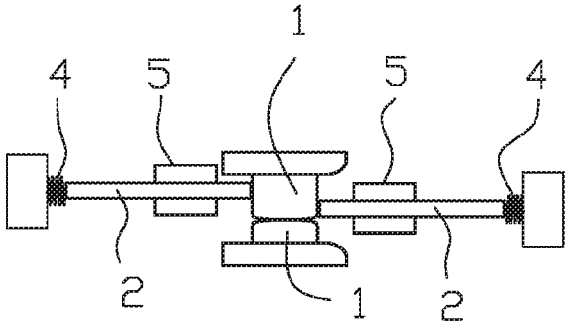
FIG. 4 is a side view of the circuit-breaker in the first embodiment of the invention.

It should be noted that under the condition of no conflicts, the embodiments of the invention and the features of the embodiments can be combined as needed.

As shown in FIGS. 1 to 6, disclosed is a circuit-breaker of multiple partition plates 2, comprising two electrode contacts 1 for switching on and off a circuit, wherein the plurality of partition plates 2 are arranged between the two electrode contacts 1, and configured to be inserted between the two electrode contacts 1 while the two electrode contacts are being separated to cutoff power.

Preferably, the plurality of partition plates 2 are arranged on both sides of a vertical plane between the two electrode contacts 1, and when the two electrode contacts 1 are separated to cutoff power, the plurality of partition plates 2 are inserted oppositely between the two electrode contacts 1 from both sides of the vertical plane. Alternatively, the plurality of partition plates 2 may be inserted respectively between the two electrode contacts 1 in the same direction or different directions. The plurality of partition plates 2, being inserted simultaneously between the two electrode contacts 1 from different directions, is capable of shortening their isolating and sealing travel, and thereby increase the breaking and insulating speed of the circuit-breaker.

Preferably, for each two opposing partition plates 2 respectively on both sides, the partition plate 2 on at least one of the sides is provided with a notch 3 or a through hole for allowing the electrode contacts 1 to pass through. The notch 3 is arranged at a corner or edge of the partition plate 2, and the through hole is arranged in the partition plate 2. Preferably, the notch 3 or the through hole has a size slightly greater than the cross section of the electrode contacts 1, so that the electrode contacts 1 can just pass through the through hole. The notch 3 or the through hole is designed according to the size and shape of the cross section of the electrode contacts 1, it is preferred that the notch 3 or the through hole is designed to be slightly greater than the cross section of the electrode contacts 1 in size. Specifically, under the state that the circuit-breaker is on, it is preferred that the notch 3 or the through hole can just surround the electrode contacts 1 without interfering with the electrode contacts 1 during the breaking action. The structure design of the notch or through hole is merely one of preferred embodiments of the invention, and the notch or through hole design does not have to be adopted, for example, the side edges of the partition plates can be in contact with one another, as in the fifth embodiment of the invention (shown in FIGS. 15 and 16).

Preferably, each two opposing partition plates 2 on both sides are placed in staggered relationship and their side surfaces are in contact with each other. The two opposing partition plates 2 on both sides are configured to slide oppositely towards each other into a gap between the two electrode contacts 1 when the two electrode contacts 1 are disconnected. When the two opposing partition plates 2 on both sides, for example, a upper partition plate 2 and a lower partition plate 2, or a left partition plate 2 and a right partition plate 2, are inserted oppositely between the two electrode contacts 1, as opposite motions towards each other may cause collisions easily, in the invention a solution is provided that the two opposing partition plates 2 are placed in staggered relationship and their side surfaces are in contact with each other. In this way, when the two electrode contacts 1 are disconnected, the two opposing partition plates 2 on two sides can slide oppositely towards each other between the two electrode contacts 1 without any head-on collision, and whereby the safety, stability and reliability of the circuit-breaker are enhanced.

Preferably, at least one of the plurality of partition plates 2 is connected to a pressure spring 4, and abuts against the electrode contacts 1, so that when the electrode contacts 1 are separated, the pressure spring 4 stretches and produces a driving force to force the partition plate 2 to insert between the two electrode contacts 1. The pressure spring 4 stores energy when the two electrode contacts 1 are in contact, and rapidly stretches and forces the partition plate 2 into the gap between the two electrode contacts 1 when the two electrode contacts 1 are separated, and whereby the insertion of the partition plate 2 is faster.

Preferably, the partition plates 2 are provided with limit blocks 5 for limiting the travel of the partition plates 2.

As shown in FIGS. 1 to 4, in a first embodiment of the invention, the plurality of partition plates 2 are inserted into, or pulled out from, between the two electrode contacts 1 linearly. When the electrode contacts 1 are in contact with each other, the two partition plates 2 are located respectively on an upper side and a lower side (or left and right) of the electrode contacts 1. The upper partition plate 2 is provided with the notch 3 in a lower edge thereof, and the lower partition plate 2 is provided with the notch 3 in an upper edge thereof, one of the electrode contacts 1 passes through the notches 3 of the upper and lower partition plates 2, and the bottoms of the notches 3 of the upper and lower partition plates 2 abut against the electrode contact 1. In order to clearly indicate the electrode contacts 1 and the notches 3 in FIG. 1, the electrode contact 1 is drawn separately, which does not indicate the actual positional relation between the electrode contact 1 and the partition plates 2.

Figure 9:
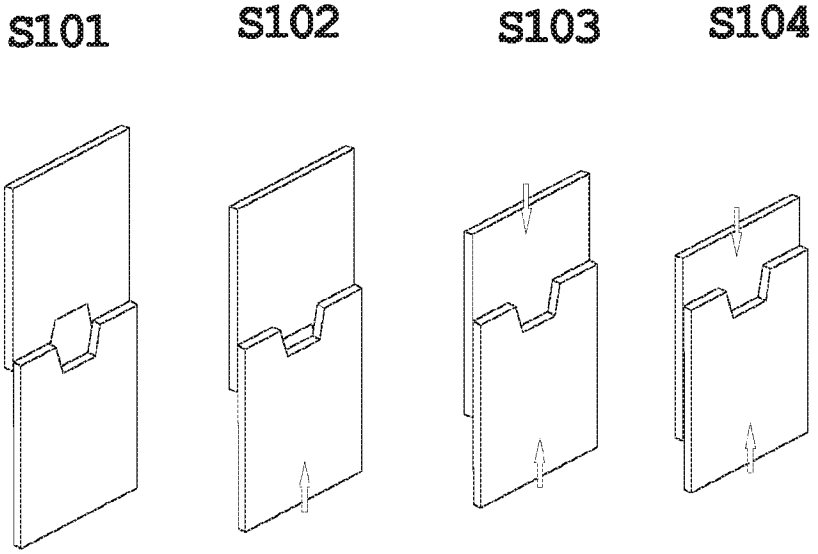
FIG. 9 is a step-by-step workflow diagram of the circuit-breaker in the first embodiment of the invention.
Figure 10:
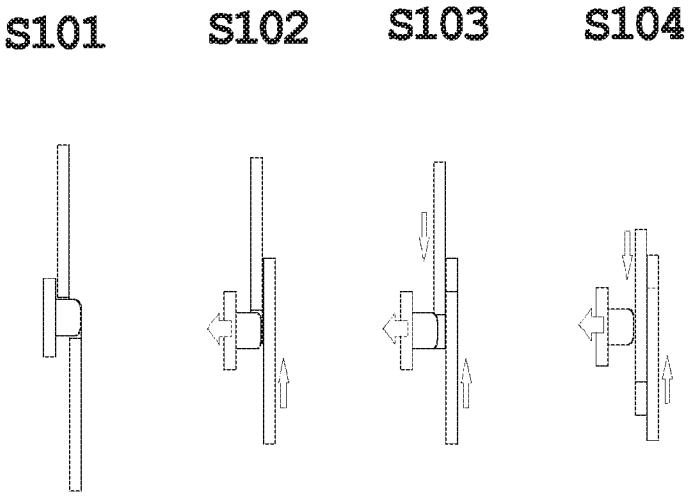
FIG. 10 is a step-by-step workflow diagram of the circuit-breaker in the first embodiment of the invention in a cross-sectional side view.
Figure 11:
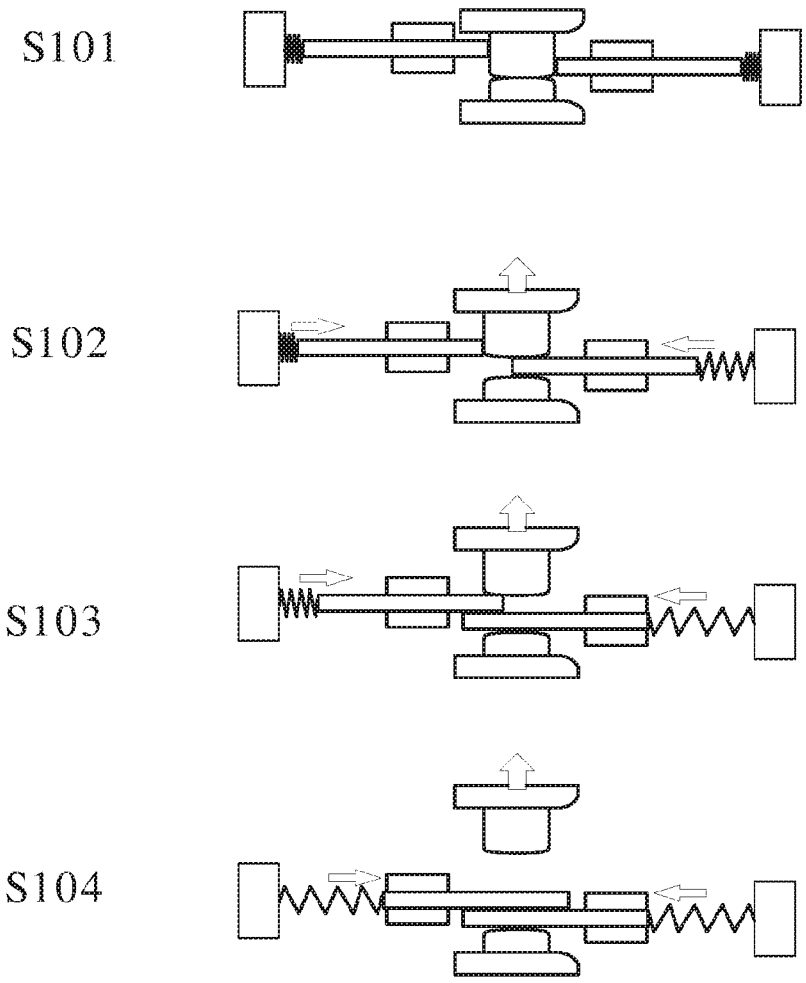
FIG. 11 is a step-by-step workflow diagram of the circuit-breaker in the first embodiment of the invention in a side view.

As shown in FIGS. 9 to 11, a step-by-step workflow of the circuit-breaker in the first embodiment of the invention can be described as follows.

S101. The two electrode contacts 1 are in contact with each other, one of the electrode contacts 1 extends through the notches 3 of the upper and lower partition plates 2 to contact the other one of the electrode contact 1, the bottoms of the notches 3 of the upper and lower partition plates 2 abut against the electrode contacts 1, and the upper and lower partition plates 2 are placed in staggered relationship and their side surfaces are in contact with each other. None or only one of the electrode contacts 1 is shown in FIGS. 9 and 10.

S102. The two electrode contacts 1 or one of the electrode contacts 1 (not shown in FIG. 9) starts to move for separation, and the upper and lower partition plates 2 lose support from the electrode contacts 1 one after another, and thus slide between the two electrode contacts 1 one after another under the pressure of the pressure springs 4 (not shown in FIGS. 3 and 4).

S103. The two electrode contacts 1 or one of the electrode contacts 1 continues to move, and the upper and lower partition plates 2 continue to slide between the two electrode contacts 1 until the two connected electrode contacts 1 are isolated and sealed from each other completely.

S104. The upper and lower partition plates 2 continue to move between the two electrode contacts 1 until the limit blocks 5 (not shown in FIGS. 9 and 10) are in contact with the opposite partition plates 2, and whereby an opening of the circuit-breaker is completed.

Figure 5:
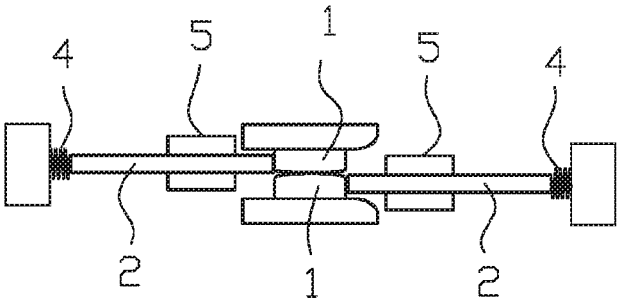
FIG. 5 is a side view of a circuit-breaker in a second embodiment of the invention.

As shown in FIG. 5, in a second embodiment of the invention, the circuit-breaker differs from the first embodiment in that, when the two electrode contacts 1 are closed, the two electrode contacts 1 respectively extend through the notches 3 of the left and right partition plates 2 to contact with each other, and the bottoms of the notches 3 of the left and right partition plates 2 respectively abut against the two electrode contacts 1.

Figure 12:
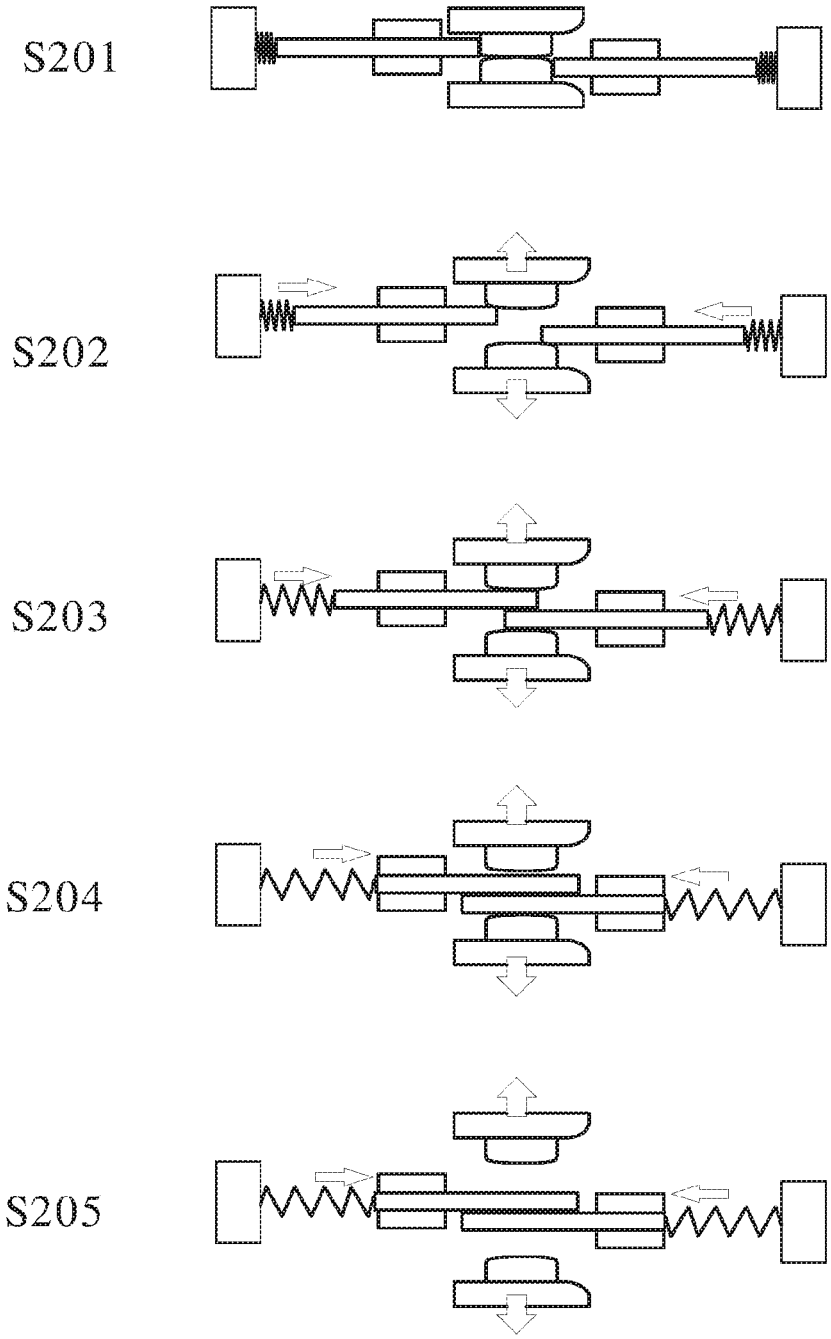
FIG. 12 is a step-by-step workflow diagram of the circuit-breaker in the second embodiment of the invention in a side view.

As shown in FIG. 12, a step-by-step workflow of the circuit-breaker in the second embodiment of the invention can be described as follows.

S201. The two electrode contacts 1 are in contact with each other, the two electrode contacts 1 respectively extend through the notches 3 of the left and right partition plates 2 to contact each other, the bottoms of the notches 3 of the left and right partition plates 2 respectively abut against the two electrode contacts 1. The left and right partition plates 2 are placed in staggered relationship with side surfaces in contact with each other.

S202. The two electrode contacts 1 simultaneously start to move for separation, and the left and right partition plates 2 simultaneously lose support from the electrode contacts 1, and thus slide between the two electrode contacts 1 one after another under the pressure of the pressure springs 4.

S203. The two electrode contacts 1 or one of the electrode contacts 1 continues to move, and the left and right partition plates 2 continue to move between the two electrode contacts 1.

S204. The left and right partition plates 2 completely isolate and seal the two connected electrode contacts 1 from each other.

S205. The left and right partition plates 2 continue to move in between the two electrode contacts 1 until the limit blocks 5 are in contact with the opposite partition plates 2, and whereby an opening of the circuit-breaker is completed.

Figure 6:
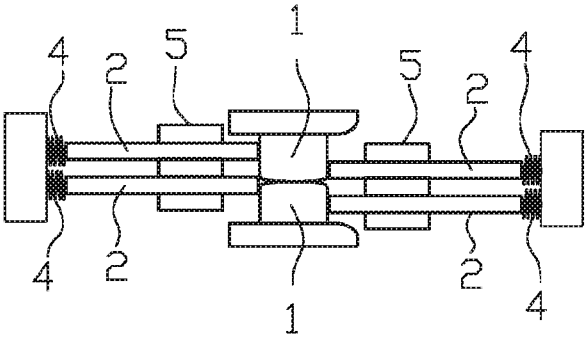
FIG. 6 is a side view of a circuit-breaker in a third embodiment of the invention.
Figures 7, 8:
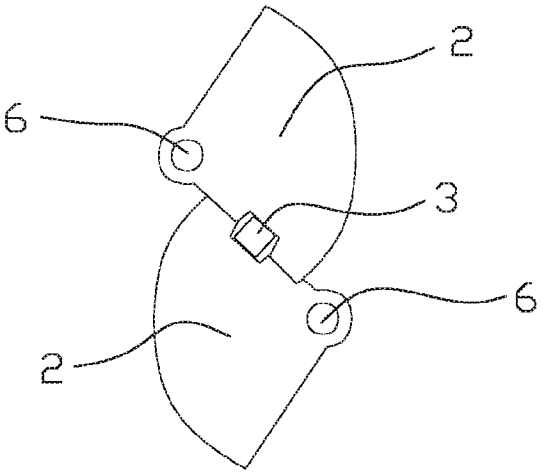
FIG. 7 is a schematic view of the circuit-breaker in the third embodiment of the invention.
FIG. 8 is a front view of a circuit-breaker in a fourth embodiment of the invention.

As shown in FIGS. 6 and 7, in the third embodiment of the present invention, the circuit-breaker differs from the second embodiment in that the four partition plates 2 are adopted and arranged in staggered relationship on the left and right sides of the two electrode contacts 1, and the side surfaces of the adjacent partition plates 2 on both sides are in contact with each other.

Figure 13:
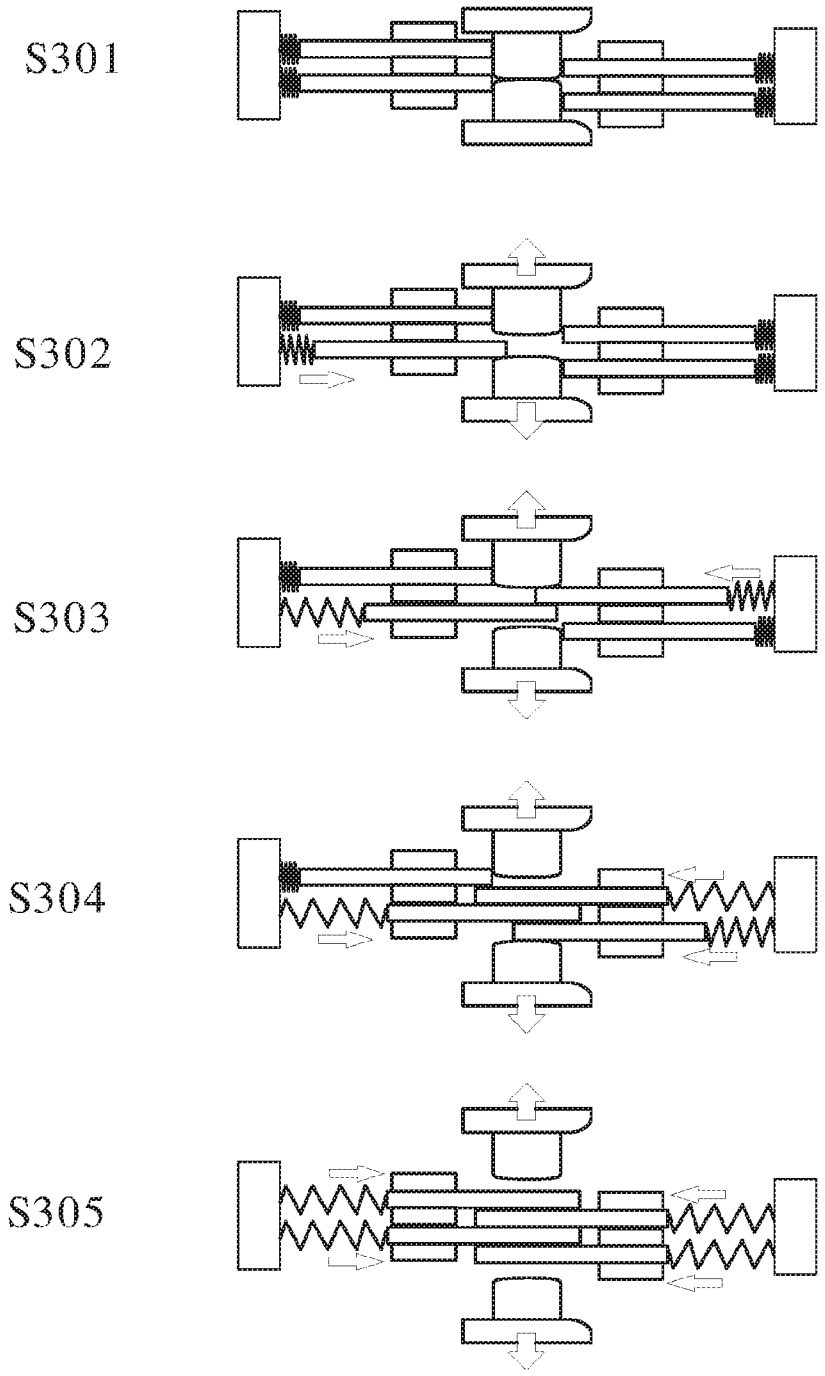
FIG. 13 is a step-by-step workflow diagram of the circuit-breaker in the third embodiment of the present invention in a side view.

As shown in FIG. 13, steps S301 to S305 in the step-by-step workflow of the circuit-breaker in the third embodiment correspond to the steps S201 to S205 in the step-by-step workflow in the second embodiment, and therefore are not repeated herein.

The number of the partition plates 2 can be two or any number greater than two, which all fall within the scope of protection of the invention.

As shown in FIG. 8, in the fourth embodiment of the invention, the circuit-breaker differs from the first embodiment in that each of the two opposing partition plates 2 on both sides is provided with a pivoted shaft 6, and thus can swing around the pivoted shaft 6 so as to move in or out between the two electrode contacts 1.

Figure 14:
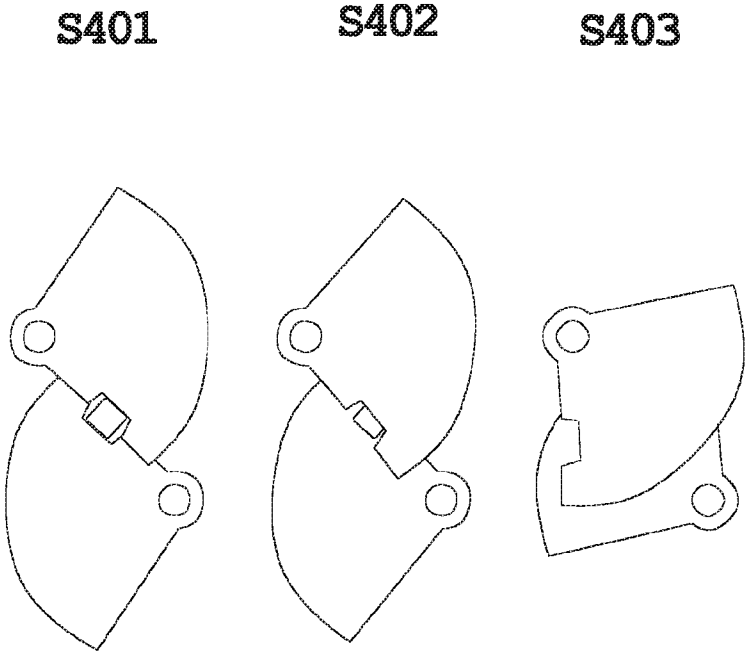
FIG. 14 is a step-by-step workflow diagram of the circuit-breaker in the fourth embodiment of the present invention in a side view.

As shown in FIG. 14, a step-by-step workflow of the circuit-breaker in the fourth embodiment of the invention can be described as follows.

S401. The two electrode contacts 1 are in contact with each other, one of the electrode contacts 1 extends through the notches 3 of the partition plates 2 on both sides to contact the other one of the electrode contacts 1, the bottoms of the notches 3 of the partition plates 2 on both sides abut against the electrode contacts 1. The partition plates 2 on both sides are placed in staggered relationship, and their side surfaces are in contact with each other. The electrode contacts 1 are not shown in FIG. 14.

S402. The two electrode contacts 1 or one of the electrode contacts 1 moves for separation, and the two partition plates 2 on both sides lose support from the electrode contacts 1 one after another, and thus swing around the respective pivoted shafts 6 under an external force, to move in between the two electrode contacts 1 one after another or simultaneously.

S403. The two partition plates 2 on both sides continue to swing to move between the two electrode contacts 1 until the two connected electrode contacts 1 are isolated and sealed from each other completely, and whereby an opening of the circuit-breaker is completed.

Figure 15:
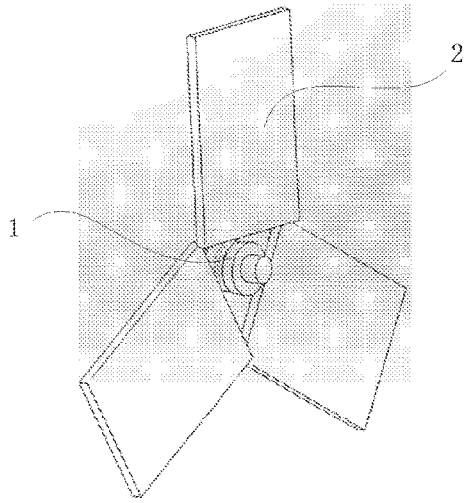
FIG. 15 is a front view of a circuit-breaker in a fifth embodiment of the invention.

As shown in FIG. 15, in a fifth embodiment of the invention, three partition plates are arranged respectively in three corresponding directions with a center defined by a contact position on a vertical plane between the two electrode contacts 1. When the two electrode contacts 1 are disconnected, at least one of each two adjacent partition plates 2 in the three corresponding directions slides relative to the other between the two electrode contacts.

Figure 16:
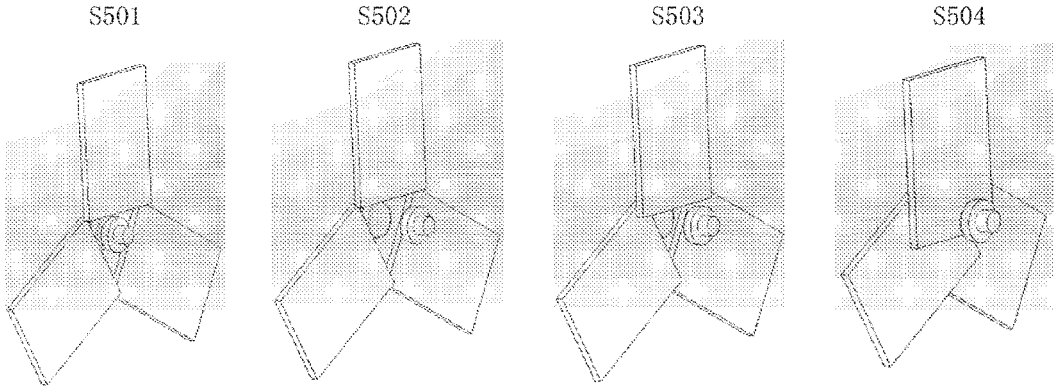
FIG. 16 is a step-by-step workflow diagram of the circuit-breaker in the fifth embodiment of the invention.

As shown in FIG. 16, a step-by-step workflow of the circuit-breaker in the fifth embodiment of the invention can be described as follows:

S501. The two electrode contacts 1 are in contact with each other, one of the electrode contacts 1 extends through a central position defined by the three partition plates 2 to contact the other one of the electrode contacts 1, the three partition plates 2 are placed in staggered relationship and their side surfaces are in contact with one another.

S502. The two electrode contacts 1 or one of the electrode contacts 1 starts to move for separation, and the three partition plates 2 lose support from the electrode contacts 1 one after another, and thus move in between the two electrode contacts 1 one after another under the pressure of the pressure springs 4 (not shown in the figure).

S503. The two electrode contacts 1 or one of the electrode contacts 1 continues to move, and the three partition plates 2 continue to move between the two electrode contacts 1 until the two connected electrode contacts 1 are isolated and sealed from each other completely.

S504. The three partition plates 2 continue to move between the two electrode contacts 1 until the limit blocks (not shown in the figure) stop the partition plates, and whereby the opening of the circuit-breaker is completed.

A plurality of partition plates 2 can be arranged in a plurality of corresponding directions with a center defined by the contact position on the vertical plane between the two electrode contacts 1. Only two or three directions are taken as an example for an illustrative purpose herein, other cases are similar to these two, and therefore are not repeated herein.

To sum up, by arranging the plurality of partition plates 2 between the electrode contacts 1, the invention enhances the insulation and arc extinguishing effects of the circuit-breaker during circuit breaking. As the plurality of partition plates 2 can be inserted simultaneously between the two electrode contacts 1 from different directions, the breaking and insulation speed, as well as the isolation and sealing effects between each two electrode contacts 1 are enhanced. Moreover, according to the invention, the circuit breaker has a simpler structure, lower manufacturing costs, and higher economic and social benefits.

In addition, according to the invention, the notches 3 or the through holes are provided in the partition plates 2, and designed in accordance with the size and shape of the cross section of the electrode contacts 1, whereby the insulation and sealing effects are much better when the circuit-breaker is switched off. Since each two opposing partition plates 2 on both sides are placed in staggered relationship with their side surfaces in contact with each other, the partition plates 2 can slide relatively between the two electrode contacts 1, and thereby prevent mutual collision between the partition plates 2. Moreover, since the pressure springs 4 are arranged on the partition plates 2 and the partition plates 2 abut against the electrode contacts 1, the insertion of the partition plates 2 is much faster.

The present invention can be applied widely to various circuit-breakers.

The invention is described in detail above by preferred embodiments, however, the invention is not limited to the embodiments, those skilled in the art can also make various equivalent modifications or replacements without departing from the spirit of the present invention, and these equivalent modifications or replacements shall be included in the scope defined by the claims of the application.

What is claimed is:

1. A quick arc-breaking circuit-breaker, comprising:

two electrode contacts for switching on and off a circuit; and a plurality of partition plates arranged between the two electrode contacts;

wherein the plurality of partition plates are arranged along corresponding directions with a center defined by a contact position in a vertical plane between the two electrode contacts, respectively; each two adjacent partition plates in the corresponding directions are disposed in staggered relationship with side surfaces thereof in contact with each other, and configured in such a way that, when the two electrode contacts are disconnected, at least one of each two adjacent partition plates in the corresponding directions slides relative to the other between the two electrode contacts; and wherein at least one of the partition plates is connected to a pressure spring and abuts against the electrode contacts, and the pressure spring is configured to force at least one of the partition plates to slide in between the two electrode contacts when the electrode contacts are separated.

2. The quick arc-breaking circuit-breaker according to claim 1, wherein the plurality of partition plates are arranged respectively in three corresponding directions with the center defined by the contact position in the vertical plane between the two electrode contacts, and configured in such a way that, when the two electrode contacts are disconnected, at least one of each two adjacent partition plates slides relative to the other between the two electrode contacts.

3. The quick arc-breaking circuit-breaker according to claim 1, wherein at least one of the two adjacent partition plates on both sides is provided with a notch or a through hole for allowing the electrode contacts to pass through, the notch is arranged at a corner and side edge position of the partition plate, and the through hole is arranged in the partition plate.

4. The quick arc-breaking circuit-breaker according to claim 3, wherein the notch and the through hole has a size slightly greater than a cross section of the electrode contacts, so that the electrode contacts can just pass through the notch and the through hole.

5. The quick arc-breaking circuit-breaker according to claim 4, wherein the partition plates are provided with limit blocks for limiting a travel of the partition plates.

6. The quick arc-breaking circuit-breaker according to claim 1, wherein the partition plates are inserted in or pulled from between the two electrode contacts linearly.

7. The quick arc-breaking circuit-breaker according to claim 1, wherein each of the partition plates is provided with a pivoted shaft for being swingable in a direction around the pivoted shaft, to be inserted in or withdrawn from between the two electrode contacts.

* * * * *